United States Patent [19]

Evin

[11] 4,386,438

[45] Jun. 7, 1983

[54] GARMENTS HAVING DETACHABLE LINERS THEREFOR

[76] Inventor: Richard A. Evin, 27 Haltham Rd., Hampstead, Que., Canada

[21] Appl. No.: 279,652

[22] Filed: Jul. 2, 1981

[51] Int. Cl.[3] ..... A47D 27/22

[52] U.S. Cl. ..... 2/272

[58] Field of Search ..... 2/272, 227, 211, 97, 2/190, 164

[56] References Cited

U.S. PATENT DOCUMENTS

| | | | |
|---|---|---|---|
| 2,138,041 | 11/1938 | Preston | 2/DIG. 2 |
| 2,151,089 | 7/1950 | Kahmi | 2/211 |
| 2,322,510 | 6/1943 | Dufine | 2/97 |
| 4,103,361 | 8/1978 | Carmen | 2/97 |

*Primary Examiner*—Doris L. Troutman

*Attorney, Agent, or Firm*—Swabey, Mitchell, Houle, Marcoux & Sher

[57] ABSTRACT

A garment comprising a shell having opposed edges along which the garment may be opened and closed and a gusset strip which is detachably securable between the edges to expand the girth of the garment when a thermal liner is used therewith. The liner is secured to the gusset strip adjacent one edge thereof and by a detachable fastener such as a Velcro (TM) fastener to the interior surface of the shell, thereby permitting the garment to be opened and closed along one of the edges of the shell in the same manner as if the liner were not present.

10 Claims, 4 Drawing Figures

GARMENTS HAVING DETACHABLE LINERS THEREFOR

FIELD OF INVENTION

The present invention relates to garments of a type wherein an outer shell is expandible in order to accommodate a liner of insulating material.

BACKGROUND OF INVENTION

It is generally known to provide in a garment a liner of insulating material therefor, which liner may be removed or attached to the outer shell of the garment in accordance with the season.

In U.S. Pat. No. 4,103,361 issued Aug. 1, 1978 and commonly owned herewith, there is described a garment having a detachable liner wherein the outer shell is expanded in girth when the liner is secured in position, so as to maintain proper fit of the garment. In accordance with the patent, the garment has edges along which the garment is normally opened and closed, and a closure therefor e.g. a zip fastener. An expansion strip is secured between the opposed edges using two other closures, necessitating three closures to connect the shell edges. This has proved somewhat cumbersome in operation, and the stiffness increases with the number of closure devices, of particular importance when the garment is to be used under arduous conditions, for example combat clothing, or extreme cold conditions.

SUMMARY OF INVENTION

It is an object of the present invention to provide in a garment having a removable liner improvements in expanding the outer shell of the garment so as to accommodate the liner.

It is a further object of the present invention to provide in such garment improved reliability and flexability in the manner of use of the garment.

In accordance with one aspect of the invention, a garment comprises an outer shell having edges along which it may be opened and closed, and separable fastening means having complementary portions thereof adjacent each edge for opening and closing the garment. The garment further comprises a gusset strip which is removably locatable between the opposed edges so as to expand the girth of the outer shell, the gusset strip having fastening portions along opposed edges thereof for mating with the separable fastening means. A liner for the garment has a first edge portion secured to the gusset strip and a second edge portion separably secured adjacent one edge of the shell. With the liner in place, the garment may thus be opened and closed with the closure means located along one of the garment edges in the same manner as if the liner were not present.

Preferably the fastening means for opening and closing the garment comprises a slide fastener, although it will be appreciated that other fastening means may also be employed if desired.

Expediently the second edge of the liner is secured to the shell by means of Velcro (TM) fasteners.

For further comprehension of the invention and the objects and advantages thereof, reference will be had to the following description and the accompanying drawings, which show by way of illustration a preferred embodiment of the invention.

DESCRIPTION OF PREFERRED EMBODIMENT

Figure 1:
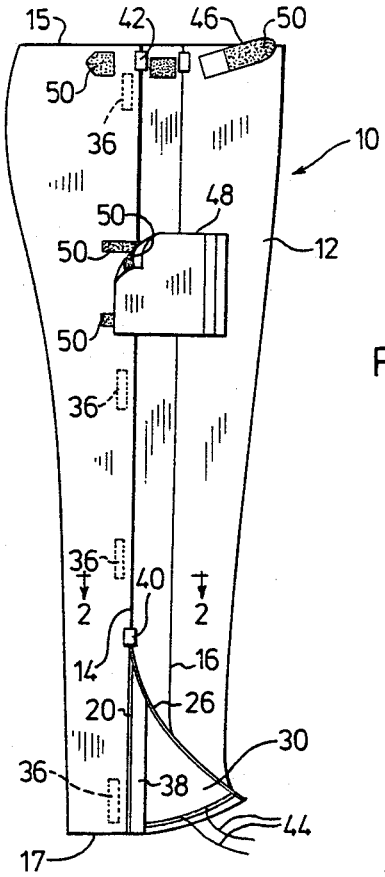
FIG. 1 is a side elevation a pair of trousers embodying the invention, including the gusset strip, and shown partly opened to reveal detail.

Referring now to the drawings in detail, a pair of trousers constructed in accordance with the invention is denoted generally by the numeral 10. Trousers 10 comprise an outer shell 12 having opposed edges 14,16 extending continuously between waist band 15 and cuff 17 of the trousers. A slide fastener 18 includes stringers 20,20 which are secured to outer shell 12 adjacent edges 14,16 respectively to permit the garment to be opened and closed. Slide fastener 18 is of a type wherein the one stringer may be completely detached from the other, whereby edges 14,16 may be completely opened along the whole length thereof.

Figure 2:
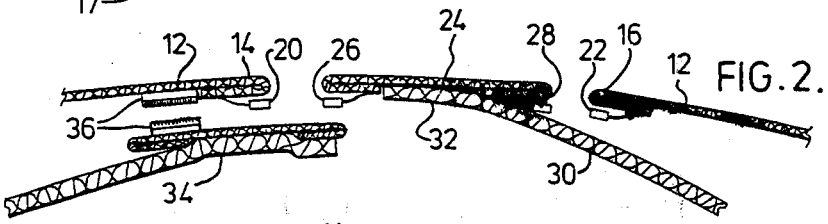
FIG. 2 is a sectional view on 2—2 of FIG. 1; shown exploded for greater clarity.
Figure 3:
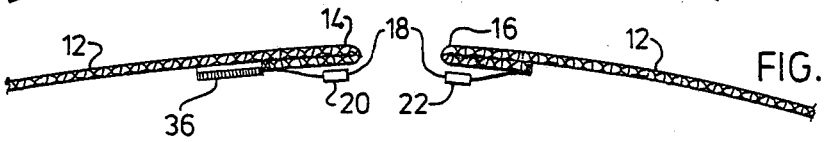
FIG.3. (PRIOR ART)
FIG. 3 is a similar section to FIG. 2, but with the gusset strip and liner removed.

Trousers 10 further include a gusset strip 24 of outer shell material for expanding the girth of shell 12 by insertion of the gusset strip between opposed edges 14,16. For this purpose gusset strip 24 is provided with slide fastener stringers 26,28 complimentary to stringers 20,22. Gusset strip 24 may thus be "zipped" into engagement with shell 12, as seen in FIGS. 1 and 2, or out of engagement as seen in FIG. 3. Gusset strip 24 is of unitary construction i.e. it is not formed of two or more pieces secured together by separable fasteners.

Reverting to FIG. 2, a liner 30 of insulating material is secured adjacent one edge 32 thereof to gusset strip 24 on the interior surface thereof by one or more rows of stitches. The distal edge 34 of liner 30 is secured to the interior surface of outer shell 12 adjacent edge 14 by means of Velcro (TM) fasteners, small strips 36 of which are sewn at intervals along the length of edge 14, as shown in dotted outline in FIG. 1. Desirably as herein distal edge 34 of liner 30 mounts a stiffening strip 38 of outer shell material which projects beyond edge 14 to underlie gusset strip 24 marginally. It will be appreciated that trousers 10 may be opened along stringers 14 and 26 when gusset strip 24 is incorporated into the shell and access gained to the interior of the garment. By contrast if shell 12 is opened along stringers 22 and 28, access will be gained to the liner only.

In order to improve the versatility in use of the trousers or other garment which the invention may be embodied I provide two slides 40,42 on the stringers for opening and closing the garment, slide 40 being shown in FIG. 1 at an intermediate position to permit the bottom of the leg of trousers 10 to open. Normally a drawstring 44 is provided at the cuff 17 of the trousers, thus preventing the cuff to open accidentally.

Trousers 10 further comprises a first flap 46 located at the waist band 15 and a second flap 48 in the form of a pocket which bridge opposed edges 14,16 and gusset strip 24 when this is in place, thereby securing to reinforce the slide fasteners and reduce the possibility of their opening when excessive force is applied to the stringer portions thereof. The flaps 46,45 are secured to outer shell 12 adjacent one opposed edge, here 16, by sewing, and conveniently adjacent the other edge by means of Velcro (TM) fasteners 50.

Figure 4:
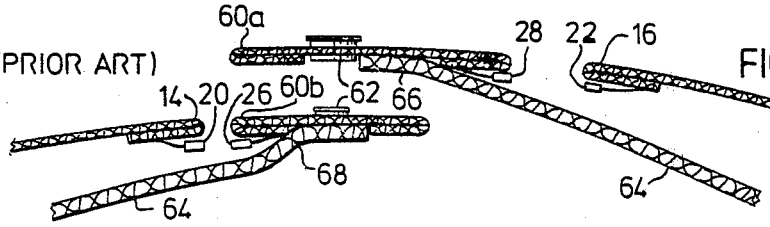
FIG. 4 is a similar view to FIG. 2, but in accordance with a prior art proposal.

The prior art arrangement for expanding a shell is illustrated in FIG. 4. In this arrangement a gusset strip is identified by the numeral 60 and comprises two portions, 60*a* and 60*b* joined by press studs 62 or a third zipper as shown in the U.S. Patent; such gusset strip is of a non-unitary construction. The united gusset strip is secured to opposed edges 14,16 of a shell garment in the same manner as herein with stringer pairs 20,26 and 22,28 of slide fasteners. A liner 64 of insulating material has a one end 66 secured to gusset strip portion 60*a*, the other end to gusset strip portion 60*b*. It will be apparent that access to the interior of the garment cannot be gained by opening either slide fastener as in the present invention, and further that the edges of shell 14 and 16 are united through three fasteners i.e. stringer pair 20,26; stud fasteners 62 or a third zipper as shown in the U.S. Patent; and stringer pair 22,28.

It is understood that the foregoing detailed description is given merely by way of illustration, and that many variations may be made therein without departing from the spirit of the invention.

I claim:

1. A garment including an outer shell having two opposed edges along which said garment is openable and closable;

first separable fastening means having complementary portions thereof secured adjacent each said edge for opening and closing said garment;

a gusset strip including fastening portions for mating with said complementary portions for detachably securing said gusset strip between said opposed edges for expanding the girth of said outer shells, and a liner for said outer shell, said liner having a first portion secured to said gusset strip and second separable fastening means having complementary portions thereof secured adjacent a second portion of said liner and said shell.

2. A garment as defined in claim 1, wherein said first separable fastening means is a slide fastener.

3. A garment as defined in claim 2, wherein said second separable fastening means comprises a Velcro (TM) fastener.

4. A garment as defined in claim 2, wherein the slide fastener for opening and closing said garment includes two slides.

5. A garment as defined in claim 3, wherein said second portion of said liner is secured to said shell adjacent one said edge thereof.

6. A garment as defined in claim 1, including a reinforcement for releasably bridging said opposed edges and said gusset strip.

7. A garment as defined in claim 6, wherein said flap portion is in the form of a pocket.

8. A garment as defined in claim 1, wherein said gusset strip is of unitary construction.

9. A garment comprising a shell having opposed edges along which said garment may be opened and closed, a unitary gusset strip which is detachably securable between said opposed edges to expand the girth of said shell, and a liner for said garment, said liner having first portions thereof secured to said gusset strip and second portions thereof detachably securable to said shell.

10. A garment as defined in claim 9, wherein said second portions of said liner are detachably securable to said shell by Velcro (TM) fasteners.

* * * * *